US006916279B2

(12) United States Patent
Endelman

(10) Patent No.: US 6,916,279 B2
(45) Date of Patent: Jul. 12, 2005

(54) DEVICE FOR ATTACHING AN ELASTIC MEMBER TO AN EXERCISE APPARATUS

(75) Inventor: Ken Endelman, Sacramento, CA (US)

(73) Assignee: Balanced Body, Inc., Sacramento, CA (US)

( * ) Notice: Subject to any disclaimer, the term of this patent is extended or adjusted under 35 U.S.C. 154(b) by 0 days.

(21) Appl. No.: 10/745,322

(22) Filed: Dec. 22, 2003

(65) Prior Publication Data

US 2004/0138034 A1 Jul. 15, 2004

Related U.S. Application Data

(63) Continuation-in-part of application No. 10/084,277, filed on Feb. 25, 2002.

(51) Int. Cl.[7] ..... A63B 21/00
(52) U.S. Cl. ..... 482/137; 482/129; 482/123
(58) Field of Search ..... 482/137, 121, 482/130; 248/68.1, 65, 300, 301, 304, 302, 200

(56) References Cited

U.S. PATENT DOCUMENTS 944,731 A * 12/1909 Gold ..... 248/68.1
1,356,040 A * 10/1920 Caskey ..... 248/58
1,917,322 A * 7/1933 Peirce, Jr. ..... 248/68.1
2,285,632 A * 6/1942 Urbain ..... 211/60.1
5,765,786 A * 6/1998 Gretz ..... 248/68.1
5,918,837 A * 7/1999 Vicain ..... 248/49
2003/0078143 A1 4/2003 Breibart et al. ..... 482/130

OTHER PUBLICATIONS

Balanced Boyd, Inc. Pilates Brochure, p. 11.
Stott Pilates Brochure.
Gratz Pilates Brochure

* cited by examiner

*Primary Examiner*—Jerome W. Donnelly
(74) *Attorney, Agent, or Firm*—John R. Wahl, Esq.; Greenbero Traurig, LLP

(57) ABSTRACT

An anchor device for elastically resistive exercise apparatus is disclosed. The cactus-tree anchor device has a rigid elongated vertical backbone. Protruding from the elongated backbone is a plurality of curved, upward-pointing arms resembling the trunk and arms of a Saguaro cactus. Pairs of these curved arms protrude from opposite sides of the elongated backbone. These arms facilitate the easy connection of elastic members, such as coil springs, to the anchor device while helping to prevent elastic members from becoming inadvertently dislodged during expansion and contraction of the elastic member. Mounting members located at upper and lower ends of the vertical backbone allow the anchor device to be mounted on or within the exercise apparatus. The anchor device is particularly adapted for use in a Pilates combination chair exercise apparatus.

6 Claims, 3 Drawing Sheets

DEVICE FOR ATTACHING AN ELASTIC MEMBER TO AN EXERCISE APPARATUS

CROSS REFERENCE TO RELATED APPLICATIONS

This application is a continuation-in-part of application Ser. No. 10/084,277, filed Feb. 25, 2002, entitled DEVICE FOR ATTACHING AN ELASTIC MEMBER TO AN EXERCISE APPARATUS.

FIELD OF THE INVENTION

This invention relates generally to exercise equipment and, more particularly, to an anchor device for elastically resistive exercise equipment.

BACKGROUND OF THE INVENTION

Today, many types of exercise equipment are available for fitness and medical purposes. These purposes include improving cardiovascular ability, toning and strengthening muscles, controlling weight, and improving flexibility. Several types of equipment aid a user in this regard by creating some form of effective resistance against repeated body movements.

A pilates-style combo chair is one such exercise device. The frame of this device is a basic box-like structure designed to rest on a horizontal surface such as a floor. One or two pivot arms protrude out of an open front of the box-like structure. Each of the pivot arms has one end fastened to the frame of the box. A step support is mounted on the free end of each pivot arm. In order to perform various exercise movements, the user typically sits on or leans against the top of the box, stepping or pressing down on the step support with his or her foot or hand to rotate the pivot arm downward. One or more elastic members, such as coil springs, provide tension against the user's downward movements.

One end of each coil spring is attached to a pivot arm. The other end of each coil spring typically has a hook that must be inserted into the eye of an eyebolt fastened to the inside or the inner sidewall of the combo chair structure. The user must physically bend down to look under the top of the chair in order to align and engage the hook into the eyebolt. This action is awkward and inconvenient for the user as it is often difficult to attach the spring without visually watching the connection as it is being made.

Thus, there is a need for an anchor that easily and securely connects one end of an elastic member, such as a coil spring, to the frame of an exercise apparatus such that the elastic member remains securely connected to the apparatus as the tension in the elastic member is varied or modulated.

SUMMARY OF THE INVENTION

An anchor device in accordance with the present invention solves the above and other problems and has a general shape of a cactus-tree. The device has a rigid elongated vertical backbone adapted to be fastened to the frame of the exercise apparatus. Protruding from the elongated backbone is a plurality of curved, upward-pointing arms resembling the arms of a Saguaro cactus. The arms are spaced along the vertical backbone and project outward from opposite sides of the backbone. These curved arms facilitate easy connection of elastic members, such as coil springs, to the anchor device while helping to prevent the elastic members from becoming inadvertently dislodged during expansion and contraction of the elastic member. Mounting members located at the top and bottom of the vertical backbone allow the anchor device to be mounted on or within a piece of exercise equipment.

One embodiment of an elastically resistive exercise apparatus that incorporates the cactus-tree anchor device of the present invention has a box-like frame structure with parallel pivot arms mounted to the frame and protruding through an open front face of the frame. Foot bar supports are provided at the distal end of each of the pivot arms. Elastic members connect the distal end of the pivot arms to the exercise apparatus frame. Each of the elastic members has a hook or eye at one end to secure the elastic member to the pivot arm and an eye or hook attached to one of the arms of the cactus-tree anchor device fastened to the frame.

These and various other features as well as advantages that characterize the present invention will be apparent from a reading of the following detailed description and a review of the associated drawings.

DETAILED DESCRIPTION OF THE INVENTION

Figure 1:
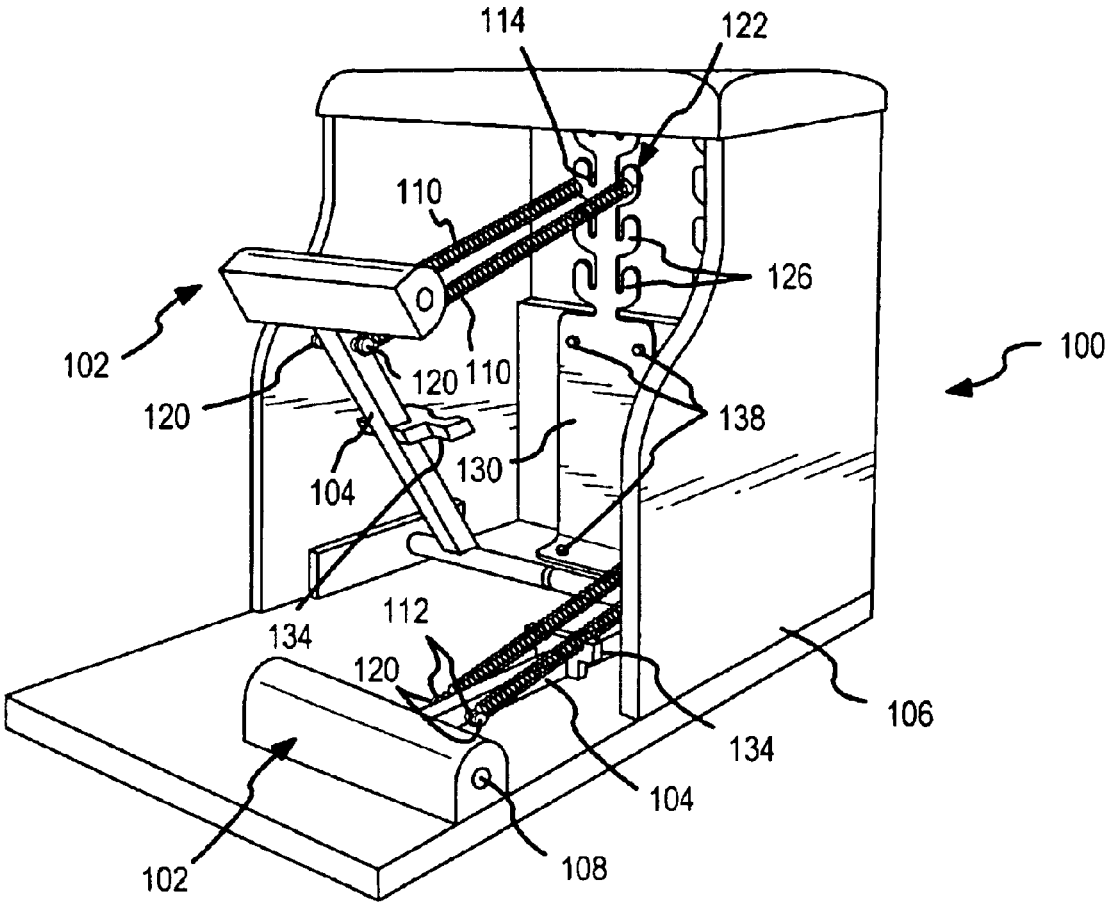
FIG. 1 is a perspective view of an exercise apparatus that incorporates an embodiment of the present invention.

One type of exercise apparatus that incorporates an embodiment of the present invention is shown in FIG. 1. This pilates-style combo chair 100 has a pair of split steps 102. The split steps 102 may easily be converted into a single step by inserting a common dowel (not shown) horizontally through a bore 108 passing longitudinally through each of the two aligned split steps 102. As shown in FIG. 1, each step 102 is at the free distal end of a pivot arm 104. The other end of the pivot arm 104 is rotatably connected to the base of the box-like frame structure 106 using a self-lubricating bearing hinge 105 for smooth operation and rotation of the arm 104. The step 102 is padded and covered with a non-slip material such as rubber to minimize accidental slippage of a user's hand or foot upon the step 102. One or more elastic members, such as coil springs 110, each have one end 112 connected to the pivot arm 104 via a hook-and-eye bolt or a knob anchor 120. The other end 114 of each spring 110 is fastened to a cactus-tree anchor 122 in accordance with the present invention. The cactus-tree anchor 122, shown in FIGS. 2 and 3, is described in detail further below.

A user typically performs various exercises by placing one or both feet upon the step 102, supporting the remainder of his or her body on the top of the chair 100, and performing a series of stepping movements, pushing against the steps 102. The springs 110 provide a level of resistance that may be varied by changing the combination of springs 110, and/or by moving the elastic members to different arms 126 of the cactus-tree anchor 122. For example, the combo chair 100 of FIG. 1 has two knob anchors 120 on each pivot arm 104 and eight arms on each of the cactus-tree anchors 122 to which elastic member ends 114 may be connected. Either one or both of the springs 110 may be attached to the cactus tree anchor 122 on different arms 126. As each arm 126 is at a different position with respect to the pivot of the arm 104, the range of resistance provided by the spring 110 through the arc of motion will be different.

Those skilled in the art should appreciate that the scope of the present invention includes a wide variety of elastically resistive exercise apparatuses with elastic member anchor devices mounted in or within these apparatuses. The Pilates-style combo chair 100 is described as an exemplary piece of equipment that benefits from the present invention and should not be viewed as limiting the equipment embodied in the present invention.

Figure 2:
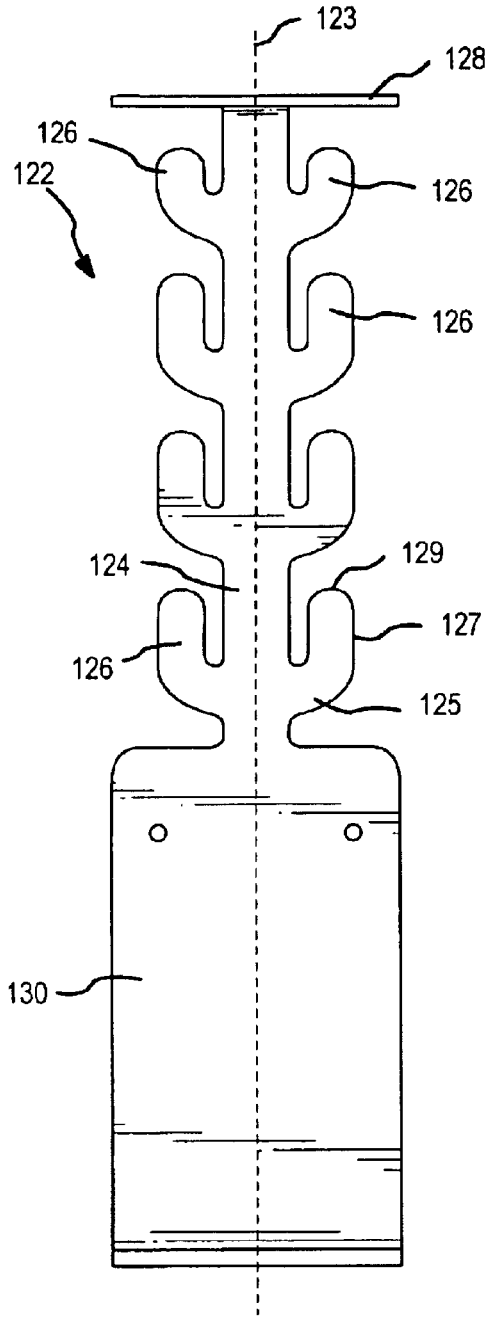
FIG. 2 is a separate front view of an anchor device in accordance with an embodiment of the present invention.
Figure 3:
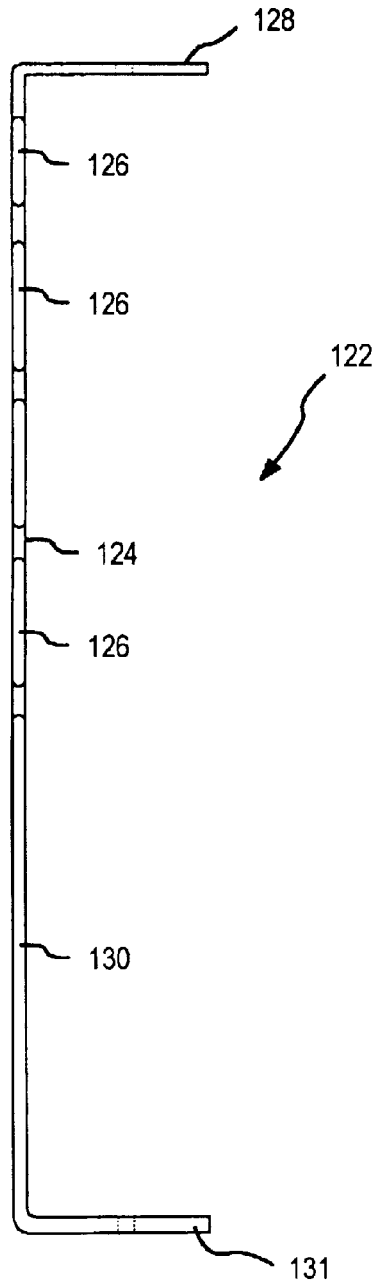
FIG. 3 is a separate side view of the anchor device shown in FIG. 2.

FIGS. 2 and 3 depict, respectively, separate front and side views of an embodiment of the cactus-tree anchor 122. In this preferred embodiment, the anchor 122 is formed of a single piece of sheet metal such as steel. The anchor 122 has a rigid elongated backbone 124 along a central vertical axis 123 of the anchor 122. In another embodiment of the present invention, the elongated backbone 124 may be a cylindrical rod with a substantially circular cross section. In yet another embodiment, the elongated backbone 124 may be a hollow tube with a substantially rectangular cross section. In a still further embodiment, the elongated backbone 124 may be formed in a channel shape (with a U shaped cross section) from sheet metal.

Protruding outward from the elongated backbone 124 is a plurality of arms 126. The arms 126 protrude outward from the backbone 124 in a generally horizontal direction. Each of the arms 126 has horizontal portion 125 curving into a vertical portion 127 that is generally aligned in a vertical plane with the central vertical axis 123. In the illustrated embodiment of the present invention, the vertical portions 127 of the arms 126 are extend parallel to the backbone 124 and are spaced therefrom by a gap sized to accommodate an end 114 of the springs 110. In this embodiment, the elongated backbone 124 and the upward-pointing curved arms 126 resemble the trunk and arms of a Saguaro cactus. One skilled in the art should appreciate that other placements and alignments of the arms 126 are also within the scope of the present invention.

The tips 129 of the vertical portions 127 of the arms 126 may be enlarged to inhibit slippage of an attached spring 110 from around the vertical portions 127. These enlarged tips are only one example of a feature to reduce slippage that may be employed. In another embodiment, the arms 126 may each have a slight rearward finger-like bend at the tip 129 to help prevent dislodging of the spring 110 from the cactus-tree anchor 122. In yet another embodiment of the present invention, a knob-like protrusion or band just below the tip 129 may act as a guard to hold attached end 114 of the spring 110 in place.

The upper end of the rigid elongated backbone 124 merges into an upper mounting member 128 that extends at right angle to the backbone 124. The upper mounting member 128 is used to connect the cactus-tree anchor 122 to the underside of the top of the frame 106 of the chair exercise apparatus 100. Similarly, the lower end of the backbone 124 has a lower mounting member 130 used to connect to the anchor 122 to the back of the frame 106. In one embodiment of the present invention, the mounting members 128 and 130 are flat plate portions adapted to be fastened to the top and back respectively of the exercise apparatus 100 via screws or bolts 138. The lower mounting member 130 may also have a bottom flange portion 131 that extends at right angle over the base of the chair 100 and can be additionally bolted to the base of the chair 100. One skilled in the art should appreciate that other methods of fastening the anchor 122 in place are also within the scope of the present invention.

Referring back to FIG. 1, the chair exercise apparatus 100 has two springs 110 attached to each pivot arm 104. Each spring 110 has its free end 114 free to be attached to its corresponding vertical set of arms 126 on the anchor 122 corresponding to that pivot arm 104. A user can apply either spring 114, or both, to each pivot arm 104 by simply slipping the free end 114 of each spring 110 over one of the arms 126 of the corresponding anchor 122. Spring tension may be changed by simply reaching behind the chair 100 and repositioning the end 114 of each spring 110 to a different anchor arm 126. When a spring 110 is not being used, it rests in one of a pair of generally U shaped depressions or recesses 132 in a spring cradle 134 attached to the pivot arm 104.

Figure 4:
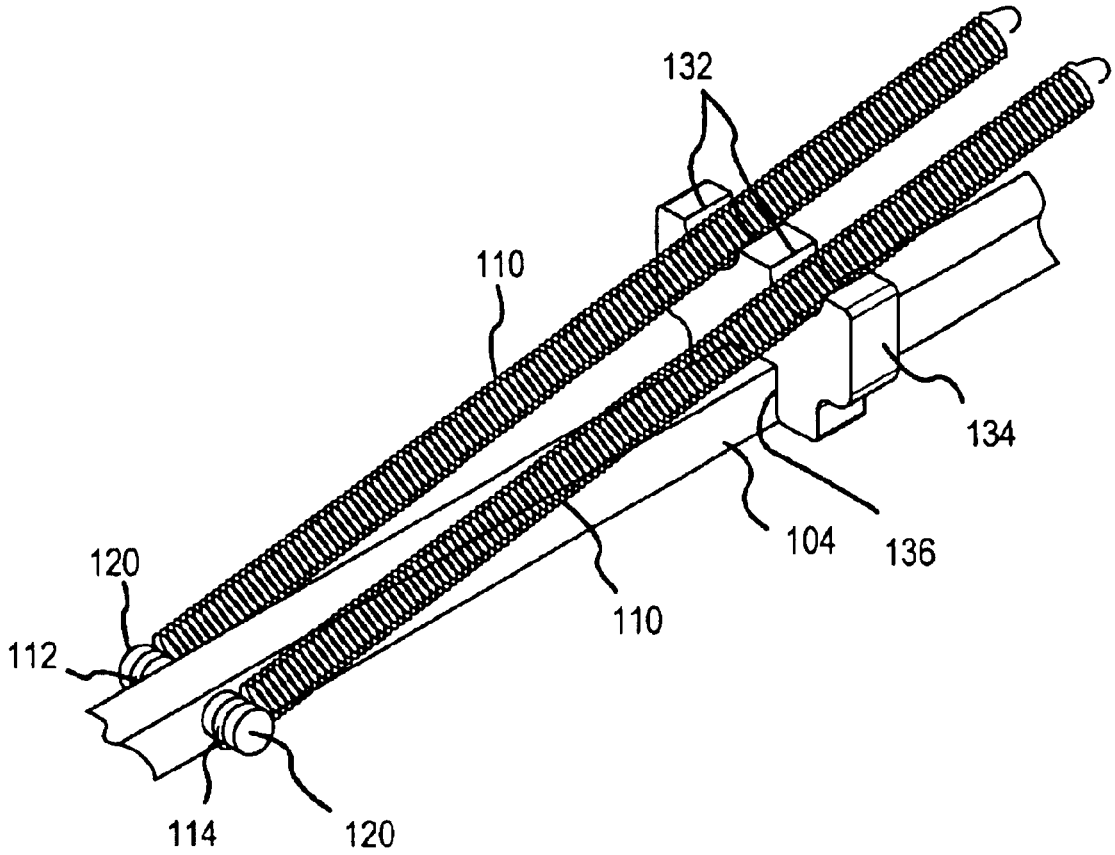
FIG. 4 is an enlarged partial perspective view of a portion of the exercise apparatus shown in FIG. 1.

The cradle 134 is best shown in FIG. 4. The cradle 134 is positioned preferably midway between the step 102 and the pivot of the arm 104. The spring cradle 134 positions the spring 110 for ready use and prevents undesirable banging around of an idle spring 110 when only one spring 110 is being used. The cradle 134 is preferable formed from plastic or wood and has a U shaped channel bottom recess 136 that fits around three sides of the pivot arm 104. The cradle 134 is preferably fastened to the pivot arm 104 with a hook and loop fastener fabric so as to be removable. However, the cradle 134 may alternatively be adhesively bonded, bolted or screwed to the pivot arm 104 for a more permanent installation.

It will be clear that the present invention is well adapted to attain the ends and advantages mentioned as well as those inherent therein. While an exemplary embodiment has been described for purposes of this disclosure, numerous changes may be made which will readily suggest themselves to those skilled in the art. In the illustrated embodiment 100, each of the springs 110 has a loop at each end for attachment to the anchor 120 on the pivot arm 104 and the anchor 122. Other arrangements at the free ends of the springs 110 may also be utilized, i.e., hooks, knobs, etc with the same result. Each of the anchor arms 126 may be shaped differently than as shown and described above. For example, the portions 127 may be curved rather than straight. They may also be bent backwards from the plane of the central backbone. The tips 129 may be enlarged. The anchor 122 may be formed of several pieces bonded together rather than formed of a single piece of sheet material. If knobs are formed on the ends 114 of the springs 110, the ends 114 may be simply slipped into the slot formed between the backbone 124 and the arms 126 of the anchor 122. All such changes are encompassed in the spirit of the invention as set forth in the following claims.

What is claimed is:

1. An exercise apparatus comprising:

a frame;

a pivoting member with a proximate end pivotally connected to the frame and a free distal end;

an elastic member having one end fastened to the pivoting member proximate to the distal end of the pivoting member; and an anchor device fastening a second end of the elastic member to the frame, the anchor device comprising:

an elongated support member having a central axial portion, an upper mounting portion, and a lower mounting portion, the mounting portions being fastened to the frame; and a first plurality of curved arms extending outward from the central axial portion wherein each curved arm has a distal end sized to receive and retain the second end of the elastic member.

2. The exercise apparatus of claim 1 wherein the distal end of each curved arm extends substantially parallel to the central axial portion.

3. The exercise apparatus of claim 1 wherein the distal end of each curved arm includes a feature shaped to prevent the second end of the elastic member from slipping off the curved arm.

4. The exercise apparatus of claim 1 further comprising a cradle fastened to said pivot arm between the distal and proximal ends for supporting the elastic member when the elastic member is not fastened between the distal end of the pivot member and the anchor device.

5. The exercise apparatus of claim 1 wherein the first plurality of curved arms extend outward from a first side of the elongated member and the first plurality of curved arms defines a first plane passing through the central axial portion.

6. The exercise apparatus of claim 5 wherein a second plurality of curved arms extend outward from a second side of the elongated member in the plane passing through the central axial portion.

* * * * *